United States Patent [19]

Ando

[11] 4,018,355

[45] Apr. 19, 1977

[54] INNER LID OF A RECEPTACLE FOR INSTANT-COOKING FOODS

[75] Inventor: Koki Ando, Osaka, Japan

[73] Assignee: Nissin Shokuhin Kaisha, Ltd., Osaka, Japan

[22] Filed: Dec. 15, 1975

[21] Appl. No.: 641,039

[30] Foreign Application Priority Data

Dec. 13, 1974 Japan ..... 49-151556[U]
Apr. 19, 1975 Japan ..... 50-53589[U]
May 16, 1975 Japan ..... 50-66590[U]

[52] U.S. Cl. ..... 220/23; 220/90.4
[51] Int. Cl.[2] ..... B65D 1/34; A47G 19/22
[58] Field of Search ..... 220/23, 90.2, 90.4; 206/219; 426/109, 113, 114

[56] References Cited

UNITED STATES PATENTS 2,609,960 9/1952 Irwin ..... 220/23 X
2,761,301 9/1956 Tellier ..... 220/90.4
3,167,079 1/1965 Weil ..... 220/23 X
3,360,160 12/1967 Spencer ..... 220/90.4

*Primary Examiner*—Stephen P. Garbe
*Assistant Examiner*—Steven M. Pollard
*Attorney, Agent, or Firm*—Wenderoth, Lind & Ponack

[57] ABSTRACT

A lid which has a bottom portion and an upwardly extending sidewall surrounding the bottom portion and which is to be removably fitted within the inside walls of a receptacle. The sidewall portion is formed with a plurality of longitudinal grooves, whereby when the lid is fitted into the receptacle, a passageway is created which connects the interior of the receptacle beneath said bottom portion with the exterior of said receptacle above said bottom portion. The lid may be made of heat-resistant plastic.

9 Claims, 7 Drawing Figures

INNER LID OF A RECEPTACLE FOR INSTANT-COOKING FOODS

This invention relates to an inner lid or more precisely a supporting partition or plate to be fitted to the top of a receptacle charged with instant-cooking food.

BACKGROUND OF THE INVENTION

Pre-cooked food for the widely used instant-cooking food, is charged into an adiabatic or heat-insulative receptacle after being dried. In preparation for consumption, hot water is poured over the food in the receptacle to reconstitute it.

When the instant-cooking food which is the principal food product and several kinds of subsidiary foods are packaged together in the receptacle and are restored by pouring hot water therein, and the poured water is sipped as soup after restoration, a top cover may be required merely to stick to the periphery of the top of the receptacle so as to be easily peeled therefrom. This top is normally formed from flexible material, such as a single sheet of paper, synthetic resin film, or aluminum foil, or a laminated layer in which above materials are suitably combined.

On the other hand, when the instant-cooking food consists of several kinds of subsidiary foods packaged separately from the principal food in the receptacle and when the subsidiary foods and seasoning are adapted to be mixed with the principal food after or upon restoration thereof, the pre-cooked subsidiary foods, as separately packaged, are normally contained in the space between the principal food and a top cover or lid within the receptacle. During preparation for consumption, a part of the lid is peeled off and hot water is poured into the receptacle after removing the separately packed subsidiary foods which will be unpacked and mixed with the hot food preparation. The removal is troublesome. Furthermore, some instant-cooking foods, such as chow-mein, pilaf, curried rice or "chicken and rice," etc. require hot water only for restoration and are ready for consumption after as much of the poured hot water is removed as is possible. In that case, in order to remove only the hot water from the reconstituted food preparation, a lid is provided with an opening through which the hot water is poured. The opening is formed by partially peeling off a part of the lid from the periphery of the opening of the receptacle, and a small gap is provided between the peeled part of the lid and the periphery of the top of the receptacle by suitably pressing the peeled part of the lid when tilting the receptacle so that no food but the water may flow out therefrom. Otherwise, small bores must be provided in the lid itself, through which the hot water is removed. However, keeping such a gap by using fingers and boring is not convenient, and certainly is laborious.

SUMMARY OF THE INVENTION

This invention provides, in addition to or separate from the lid stuck to the periphery of the top of a receptacle, an inner lid fitted inside the receptacle on which lid seasoning and other subsidiary foods are placed, and through which hot water may be poured and removed after such foods are removed for consumption.

It is an object of the present invention to provide an inner lid which permits subsidiary foods to be conveniently handled or packaged in which an inner lid forms the boundary in the receptacle between the principal food contained in the receptacle and the several kinds of subsidiary foods to be added to the principal food.

It is another object of the present invention to provide an inner lid through which hot water can be easily poured into the receptacle and also removed therefrom.

It is still another object of the present invention to provide an inner lid which may be economically manufactured in a unitary construction without requiring any special processing.

BRIEF EXPLANATION OF THE DRAWINGS

Other objects and further understanding of the present invention will be evident from the following detailed description of the invention and claims when taken in conjunction with accompanying drawings in which:

DETAILED DESCRIPTION OF THE INVENTION

The lid in accordance with the present invention may be formed in a unitary construction of synthetic resin material with upright grooves on the circumferential wall in contact with the receptacle, thereby forming a space to hold the subsidiary foods. The lid is also formed with holes through which hot water is poured into the receptacle and removed therefrom during preparation for consumption.

Figure 1:
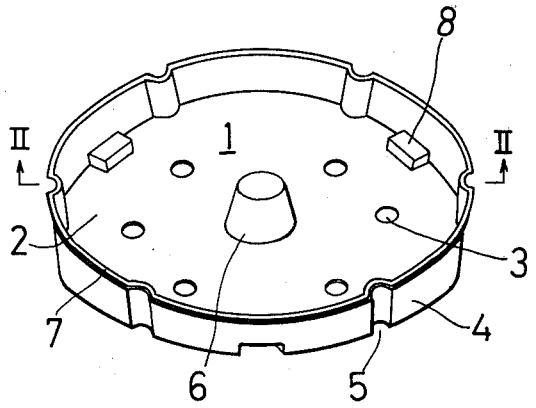
FIG. 1 is a perspective view of one embodiment of an inner lid in accordance with the present invention.
Figure 2:
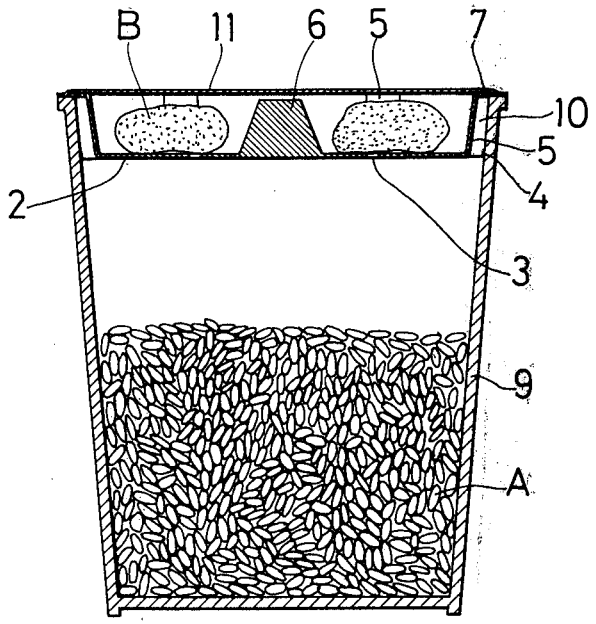
FIG. 2 is a vertical section of the inner lid as fitted in the receptacle.

An inner lid 1, preferably of heat-resistant plastic, such as polystyrene, polyethylene, polypropylene and polycarbonate, in the first embodiment shown in FIGS. 1 and 2 is provided with a number of small bores 3 at the whole bottom 2 thereof and with a plurality of upright grooves 5 on the circumferential wall 4 thereof. The inner lid 1 may also be provided with a projection 6 on the bottom 2, a flange 7 at the top edge of the circumferential wall 4, and a reinforcing step 8 at the circumferential wall 4, when the inner lid 1 is fitted into the receptacle 9, passages 10 leading to the interior and exterior of the receptacle are formed between the inner wall surface of the receptacle 9 and the grooves 5.

Figure 3:
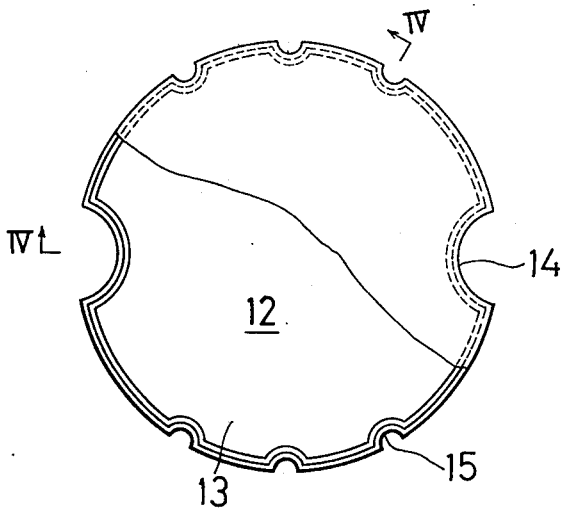
FIG. 3 is a top plan view of a second embodiment in accordance with the present invention.
Figure 4:
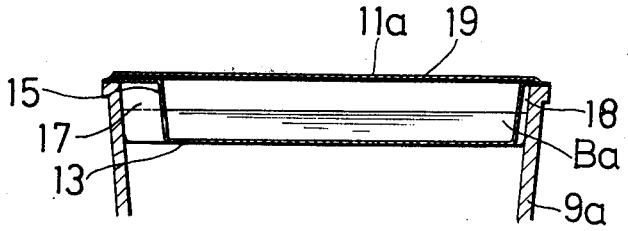
FIG. 4 is a vertical section of the second embodiment as fitted in the receptacle, taken on line IV—IV.

An inner lid 12, preferably of heat-resistant plastic, in the second embodiment shown in FIGS. 3 and 4 is provided on the circumferential wall 13 with a plurality of grooves, some of which are larger 14 in diameter than the others 15. When the inner lid 12 is fitted into the receptacle 9*a*, two differently sized passages 17 and 18 leading to and from the interior and exterior of the receptacle are formed.

Figure 5:
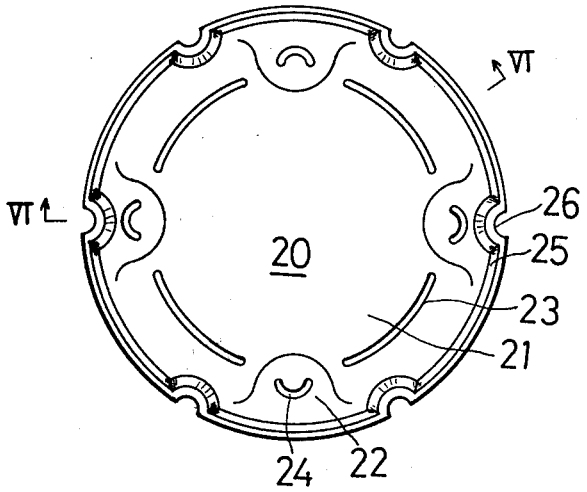
FIG. 5 is a top plan view of a third embodiment in accordance with the present invention.
Figure 6:
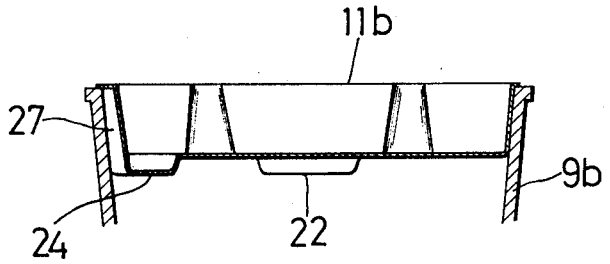
FIG. 6 is a vertical section of the third embodiment as fitted in the receptacle, taken on line VI—VI.

An inner lid 20, preferably of heat-resistant plastic, in the third embodiment shown in FIGS. 5 and 6 is provided with recesses 22 in the bottom 21 which has slots 23 in the form of parts of a circle. Each recess 22 has a slot 24, and the circumferential wall 25 is provided with grooves 26. When the inner lid 20 is fitted into the receptacle 9*b*, passages 27 leading to the interior and exterior of the receptacle are formed.

Any of the lids 1, 12 or 20 can be fitted on the top of the receptacle 9, 9*a* or 9*b*, can be charged with dried principal food A, and can hold, subsidiary foods B as they are or as suitable packaged. An outer lid 11 can also be stuck to the periphery of the top of the receptacle so as to form a cover. The types of heat-resistant plastic which may be used for these lids 1, 12 and 20 may be such plastics as polystyrene, polyethylene, polypropylene and polycarbonate.

Figure 7:
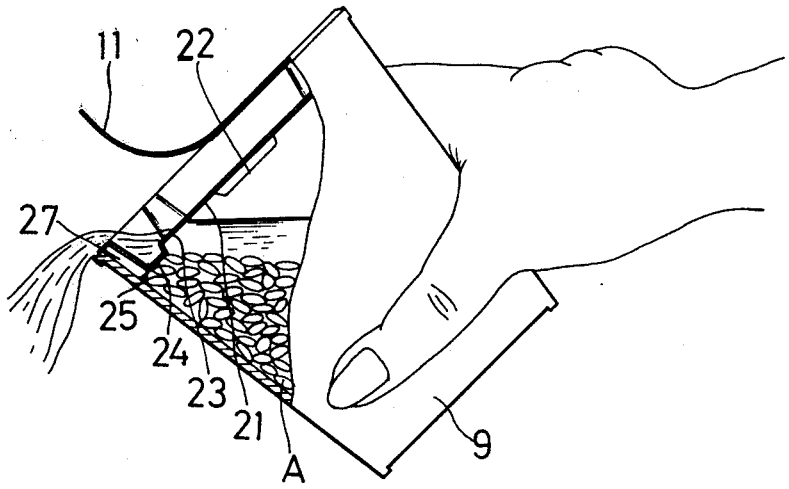
FIG. 7 is a section of the inner lid of the third embodiment partially broken away, illustrating the manner in which hot water is being removed from the receptacle.

During preparation for consumption in the first embodiment shown in FIGS. 1 and 2, the outer lid 11 is wholly or partially peeled from the top of the receptacle 9; subsidiary foods B are removed from the inner lid 1; and hot water is poured into the receptacle 9 through the small bores 3 of the inner lid 1. Passages 10 serve for exhausting air within the receptacle 9, thus permitting the poured hot water to quickly enter the receptacle 9. After the principal food A is reconstituted, the hot water is completely removed through the passages 10 and the small bores 3 by tilting the receptacle 9 as shown in FIG. 7. The inner lid 1 is then removed and the subsidiary foods B are suitably added to the principal food before eating. When the outer lid 11 is totally peeled from the receptacle, the inner lid 1 may come out from the receptacle 9 when it is tilted to remove the hot water. To prevent this, a projection 6 may be provided, which is adapted to be pressed by a finger tip while the hot water is being removed. The projection 6 may also serve to remove the inner lid 1 from the receptacle. A flange 7 engages the top of receptacle 9 so that it does not fall into the cup. In addition, when the hot water is removed in a manner such that the outer lid 11 is partially peeled from the top of the receptacle 9 as shown in FIG. 7, the major portion of the flange 7 is held between and by the outer lid 11 and the top of the receptacle 9 so that the water may not take away the inner lid 1 (which then need not be pressed by a finger tip during removal of the hot water). The reinforcing steps 8 may further be provided to reduce deformation of the inner lid due to the external pressure.

In the second embodiment shown in FIGS. 3 and 4, the lid 12 is provided with no openings or slots through the bottom, but is provided with a water-proof cover 19 to hermetically seal the lid containing the liquid subsidiary food such as soup or sauce, or granulated subsidiary food as it is. The container 9 is sealed hermetically with a cover 11*a* of a material the same as or equivalent to the plastic lid 12. The cover 11*a* is sealed over the cover 19 and closes the passages 17 and 18. During consumption, the top cover 11*a* is partially peeled away so that some of the passages 17 and 18 will present openings. Hot water is poured through the large channels 17 and the air is replaced through small channels 18. After reconstituting the principal food A, the hot water is removed through small passages 18 to prevent the food from coming out. After removing the hot water, the lids 12 and 11*a* are removed from the receptacle 9*a* and the cover 19 is peeled off to remove the additive B*a* which is added to the principal food A before eating. Passages 14 are large enough to receive a consumer's fingers so that the lid 12 may be easily removed from the receptacle.

In the third embodiment shown in FIGS. 5 and 6, hot water is poured through the slots 23 and 24, while the passages 27 serve as outlets for exhausting the air. Because they are located in a higher position than the slots 24, the slots 23 may sometimes serve as outlets for exhausting the air, while the hot water is being poured. The hot water is removed through the slots 23, 24, and 27. The recesses 22 reduce the degree of deformation due to the external pressure just as the steps 8 do in the first embodiment.

During storage, when a plurality of lids 20 are piled up, each lid is placed on the other with recesses 22 of the upper lid in disengagement from those of the lower lid so that an upper lid can easily be picked up from the next.

As is apparent from the description, the inner lid in accordance with the present invention has openings adapted for pouring hot water, for restoring instant-cooking food packed in a receptacle and for removing the hot water after restoration, whereby openings or bores for pouring and removing hot water may easily be provided by peeling away the outer lid partially or wholly. In addition, with instant cooking food in which subsidiary foods are separated from the principal food, the inner lid may be used for containing these foods.

Preferred embodiments of the present invention which have been described are shown just by way of example, and it will be possible to suitably modify the shape, size and number of the grooves small bores or slots of the inner lid, unless such modifications will cause the principal food A to flow out from the receptacle 9. The projection 6, reinforcing steps 8, and recesses 22 may be provided in any embodiment. The flange 7 is defined by no peculiar shape but must be capable of engaging the periphery of the top of the receptacle. The reinforcing steps 8 and recesses 22 may suitably be modified in shape, size and number. It will be evident that the shape, size or material of the inner lid may be modified without departing from the scope and spirit of the present invention.

What is claimed is:

1. A lid for removably fitting within the inside walls of the top of a receptacle, said lid comprising:

a bottom portion having a plurality of openings therethrough; and a circumferential wall surrounding and extending upward from said bottom portion, said wall having a plurality of longitudinally grooved portions therein the height of said wall, whereby passageways are formed between said grooved portions and the interior of said receptacle when said lid is fitted within the inside walls of said receptacle.

2. A lid as claimed in claim 1, wherein said bottom portion further has at least one recessed portion, said recessed portion having an opening therethrough.

3. A lid as claimed in claim 1, further comprising:

reinforcing steps formed at the juncture of said bottom portion and said circumferential wall, whereby the strength of said lid is increased.

4. A lid as claimed in claim 1, further comprising:

an outwardly extending flange at the upper edge of said circumferential wall for fitting over the edge of said receptacle when said lid is fitted into said receptacle.

5. A lid as claimed in claim 1, wherein:

said bottom portion has at least one outward projection extending above the top surface thereof.

6. A lid as claimed in claim 1, wherein:

said bottom portion and circumferential wall thereSurrounding are comprised of heat-resistant plastic.

7. A lid for removably fitting within the inside walls of the top of a receptacle having solid contents therewithin, said lid comprising:

a bottom portion; and a circumferential wall extending upward from said bottom portion, said wall having a plurality of longitudinally grooved portions therein the height of said wall, at least one of said grooved portions being of a size sufficient to allow the insertion of a finger thereinto and the remaining grooved portions being sufficiently small enough to prevent said solid contents of said receptacle from passing therethrough, whereby a plurality of passageways of varying sizes are formed between said grooved portions and the interior of said receptacle when said lid is fitted within the inside walls of said receptacle.

8. A lid as claimed in claim 7, further comprising:

an outwardly extending flange at the upper edge of said circumferential wall for fitting over the edge of said receptacle when said lid is fitted into said receptacle.

9. A lid as claimed in claim 7, wherein:

said bottom portion and circumferential wall theresurrounding are comprised of heat-resistant plastic.

* * * * *